US005934351A

United States Patent [19]

Bharucha et al.

[11] Patent Number: 5,934,351

[45] Date of Patent: Aug. 10, 1999

[54] SLIDING TILT MECHANISM FOR HORIZONTAL SLATTED BLINDS

[75] Inventors: Rashid Bharucha; Gregory D. De Boer; William R. Guthrie; John Scharff; Howard C. Anderson, III, all of Pelle, Iowa

[73] Assignee: Pella Corporation, Pella, Iowa

[21] Appl. No.: 09/065,697

[22] Filed: Apr. 24, 1998

[51] Int. Cl.[6] ..... E06B 9/26

[52] U.S. Cl. ..... 160/176.1 R; 160/177 R

[58] Field of Search ..... 160/176.1 R, 177 R, 160/168.1 R, 178.1 R, 178.3 R

[56] References Cited

U.S. PATENT DOCUMENTS

| | | | |
|---|---|---|---|
| 1,949,653 | 3/1934 | Moore . | |
| 2,276,898 | 3/1942 | Walker | 160/176.1 R X |
| 2,572,291 | 10/1951 | Weaver . | |
| 2,582,301 | 1/1952 | Walker . | |
| 2,687,770 | 8/1954 | Walker et al. . | |
| 3,100,013 | 8/1963 | Randmark | 160/176.1 R X |
| 3,294,153 | 12/1966 | Fountain | 160/176.1 R X |
| 4,357,980 | 11/1982 | Rapp | 160/176.1 R X |
| 4,377,194 | 3/1983 | Tsuhako . | |
| 4,687,040 | 8/1987 | Ball . | |
| 4,697,630 | 10/1987 | Rude . | |
| 4,768,576 | 9/1988 | Anderson . | |
| 4,913,213 | 4/1990 | Schnelker . | |
| 5,074,349 | 12/1991 | Yannazonne | 160/177 R |
| 5,143,135 | 9/1992 | Kuhar . | |
| 5,476,132 | 12/1995 | Jacobson . | |
| 5,611,381 | 3/1997 | Jelic . | |
| 5,788,956 | 7/1998 | Judkins . | |

*Primary Examiner*—Blair M. Johnson
*Attorney, Agent, or Firm*—Hovey, Williams, Timmons & Collins

[57] ABSTRACT

A slatted blind (10) includes a headrail (12) with a pair of ladder cords (16, 18) depending therefrom with slats (14) supported on the wefts (44, 52) extending between the warps (42*a,b*, 50*a,b*) of each cord and further includes a tilt mechanism (20) to extend one warp of each cord and to retract the other in order to tilt the slats. The preferred tilt mechanism (20) includes a pair of slides (60, 62) positioned on the bottom wall (26) of the headrail (12). The ends of the warps (42*a,b*, 50*a,b*) are coupled with the slides (60, 62) on opposed sides of respective cord holes (82, 90) defined through the slides (60, 62) and extend therethrough and also through respective cord openings (30, 32) in the bottom wall. Back and forth shifting of the slides (60, 62) along the bottom wall (26) alternately extend one warp of each cord and retract the other in order to tilt the slats.

17 Claims, 5 Drawing Sheets

SLIDING TILT MECHANISM FOR HORIZONTAL SLATTED BLINDS

RELATED APPLICATIONS

Not applicable.

FEDERALLY SPONSORED RESEARCH OR DEVELOPMENT

Not applicable.

MICROFICHE APPENDIX

Not applicable.

BACKGROUND OF THE INVENTION

1. Field of the Invention

The present invention is concerned with the field of slatted blinds for use with fenestration products such as doors and windows. In particular, the invention concerns a slatted blind including a headrail with a number of ladders depending therefrom with slats supported on the wefts extending between the warps of each ladder and further including a tilt mechanism using a number of slidable bodies to extend one warp of each ladder and to retract the other in order to tilt the slats.

2. Description of the Prior Art

In the field of slatted blinds, also known as Venetian blinds, the prior art discloses a variety of designs for tilting the slats. One design positions rotating spools above each cord ladder with the warps of each ladder oppositely wrapping a respective spool. A pair of tilt cords are connected with the spools. Pulling on one tilt cord causes the spools to rotate in order to tilt the slats in one direction and pulling on the other tilt cord causes the spools to tilt the slats in the opposite direction. These prior art tilt designs tend to be mechanically complex thereby adding to the expense of manufacturing and sometimes leading to unreliable operation.

SUMMARY OF THE INVENTION

The present invention solves the prior art problems discussed above and presents a distinct advance in the state of the art. In particular, the slatted blind hereof is mechanically simple, economical to manufacture and reliable in operation.

The preferred blind includes a headrail having a pair of spaced cord openings defined in the bottom wall thereof, a plurality of slats, a pair of cord ladders each with a pair of warps depending from the headrail through the respective openings and a plurality of wefts extending between the warps supporting the slats. The blind further includes a tilt mechanism having a pair of spaced slides shiftable along the bottom wall of the headrail with each slide including a cord hole therein. The warps of each cord ladder are coupled with a respective slide on opposed sides of the cord hole and extend therethrough and through a respective cord opening. The slides are shiftable in opposed directions for alternately retracting one of the warps of each cord ladder while extending the other warp in order to tilt the slats. Other preferred aspects of the present invention are disclosed herein.

DETAILED DESCRIPTION OF THE PREFERRED EMBODIMENT

Figure 1:
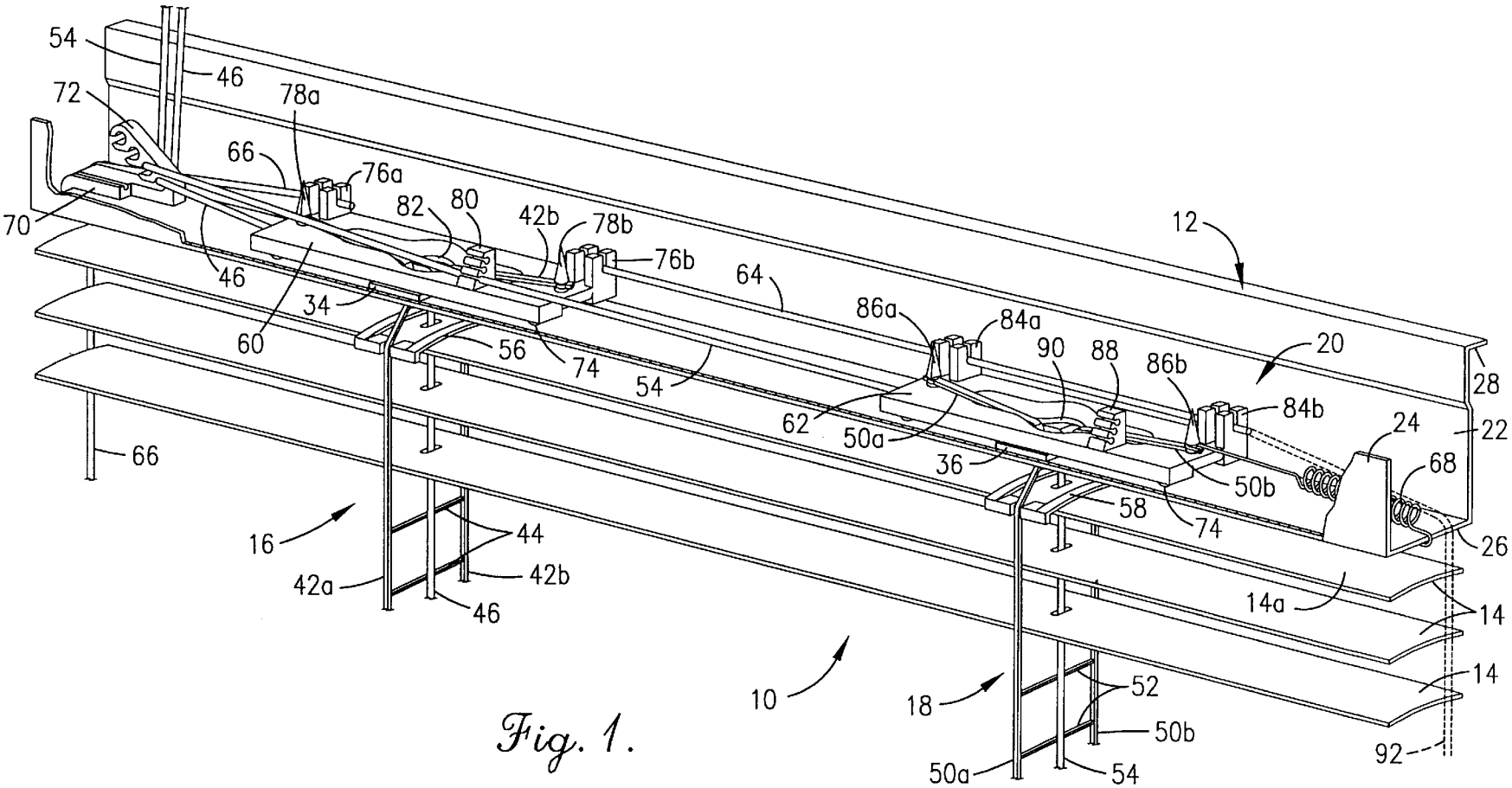
FIG. 1 is a partial pictorial view in partial section of the preferred slatted blind in accordance with the present invention.

The drawing figures illustrate preferred slatted blind 10 in accordance with the present invention. Referring initially to FIG. 1, blind 10 includes a support member in the nature of headrail 12, a plurality of slats 14, a pair of cord ladders 16 and 18, and tilt mechanism 20.

Figure 2:
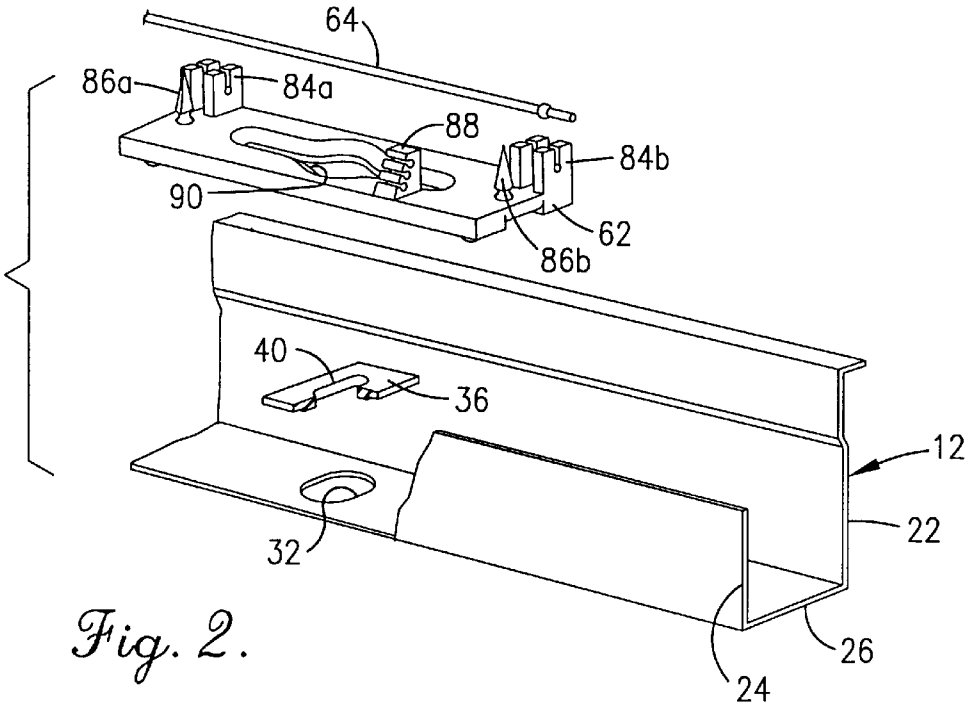
FIG. 2 is an exploded view of a portion of the headrail and a slide of FIG. 1 showing the tilt mechanism in the middle position.

As shown in the drawing figures, headrail 12 includes back wall 22, shorter front wall 24 spaced from back wall 22, and bottom wall 26 extending between the lower edges of walls 22, 24. In the preferred embodiment, walls 22–26 are integrally formed of extruded aluminum and back wall 22 includes mounting flange 28 configured as shown. Bottom wall 26 includes spaced apertures 30 and 32 defined therein that are in registration with respective cord ladders 16, 18. As best viewed in FIGS. 2–4, apertures 30, 32 include respective grommets 34 and 36 positioned therein presenting respective cord openings 38 and 40.

Figure 5:
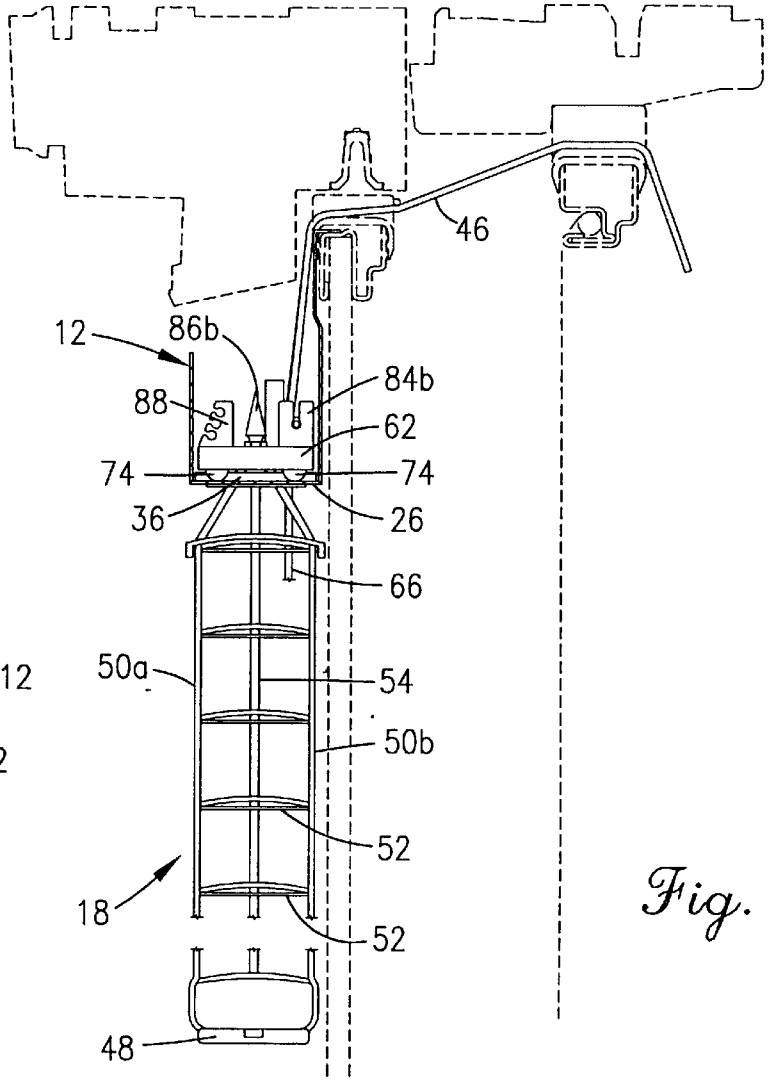
FIG. 5 is a partial, right side elevational view of the blind of FIG. 1 shown installed as part of a double glazed panel window shown in phantom lines.

Referring to FIGS. 1 and 5, left cord ladder 16 includes front warp 42*a* and spaced rear warp 42*b* with a plurality of wefts 44 extending therebetween respectively supporting slats 14 adjacent left side of blind 10, and further includes lift cord 46 extending between warps 42*a,b* with the lower end thereof terminating at bottom rail 48. Similarly, right cord ladder 18 includes front warp 50*a* and spaced rear warp 50*b* with a plurality of wefts 52 therebetween respectively supporting slats 14 adjacent the right side of blind 10, and further includes lift cord 54 extending between warps 50*a,b* and terminating at slat weight 48. Slat braces 56 and 58 are connected to uppermost slat 14*a* in registration with ladders 16, 18 as best viewed in FIG. 1.

Tilt mechanism 20 includes a pair of shifting bodies in the nature of left slide 60 and right slide 62. Mechanism 20 further includes connecting cable 64, tilt cord 66, spring 68, and tilt cord guide 70. As illustrated in FIG. 1 and others, headrail 12 also includes angled cord guide 72 positioned as shown.

Slides 60, 62 are identical, and each is integrally composed of synthetic resin material, presents a generally rectangular configuration in plan view and is slidably supported on bottom wall 26. Slide 60 includes four, downwardly extending, slide knobs 74 positioned adjacent the four corners thereof for slidably engaging bottom wall 26. The upper surface of slide 60 includes locking anchors 76*a* and 76*b* positioned at the rearward corners thereof, cord locking posts 78*a* and 78*b* centrally positioned at opposed ends of slide 60, and upstanding cord guide 80. Slide 60 further includes elongated cord hole 82 centrally defined therein. As best viewed in FIG. 3, cord hole 82 presents a generally diamond-shaped configuration having a width about the same as the width (from front to rear) of cord openings 38, 40.

Similarly, right slide 62 also includes four, downwardly extending, slide knobs 74 positioned adjacent the four corners thereof for slidably engaging bottom wall 26. The upper surface of slide 62 includes locking anchors 84*a* and 84*b* positioned at the rearward corners thereof, cord locking posts 86*a* and 86*b* centrally positioned at opposed ends of slide 62, and upstanding cord guide 88. Slide 62 further includes elongated cord hole 90 centrally defined therein with the same dimensions as hole 82.

Figure 3:
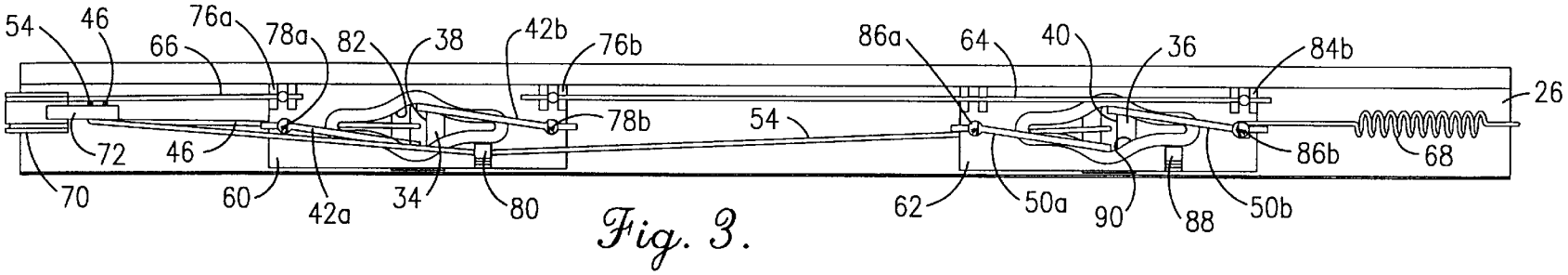
FIG. 3 is a top plan view of the blind of FIG. 1.
Figure 4:
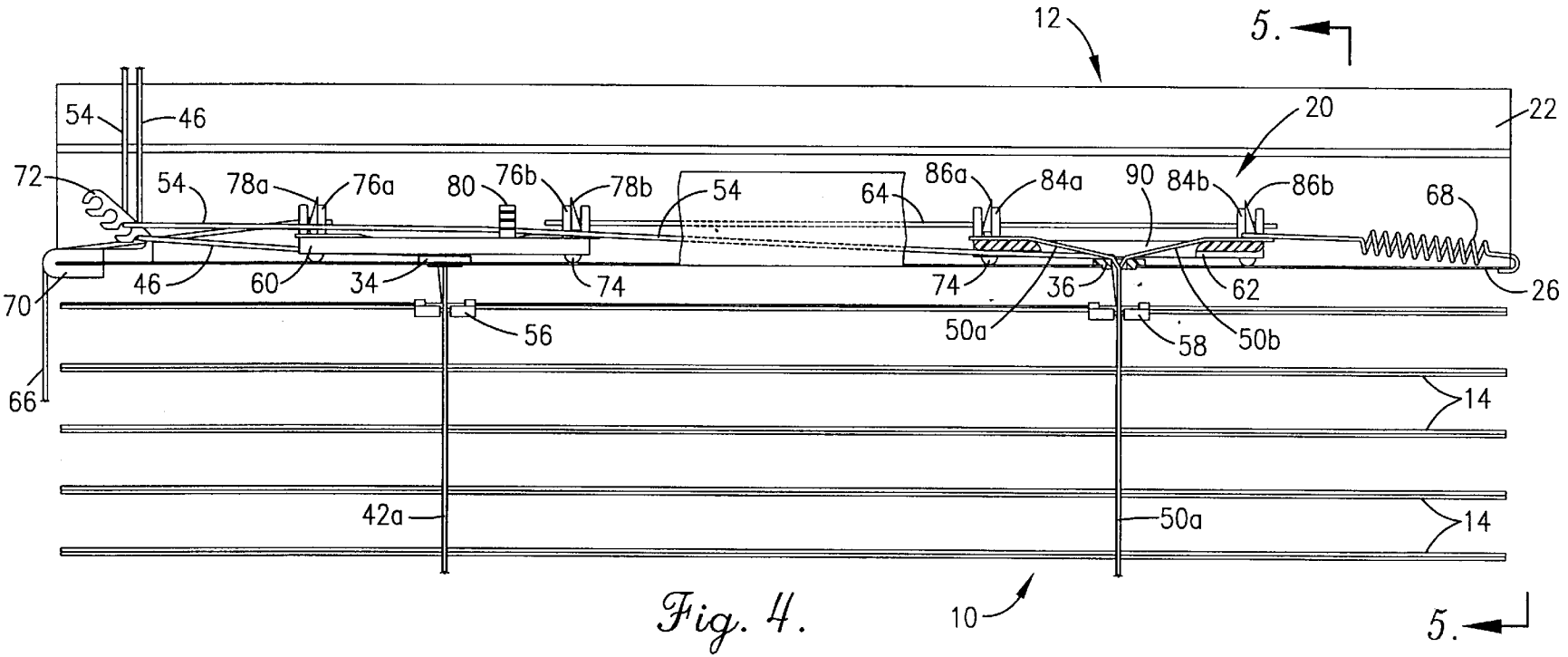
FIG. 4 is a partial elevational view in partial section of the blind of FIG. 1.

FIGS. 1 and 3–4 illustrate tilt mechanism 20 and slats 14 in the middle position. In this position, slides 60, 62 are in registration with ladders 16, 18. More particularly, cord holes 82 and 90 of slides 60, 62 are in registration with cord openings 38 and 40 of bottom wall 26.

For left cord ladder 16, warps 42*a,b* depend from slide 60. In particular, the upper stretch of front warp 42*a* is coupled with left locking post 78*a*, extends through cord hole 82 and from there through cord opening 38, as best viewed in FIG. 3. The upper stretch of rear warp 42*b* is coupled with right locking post 78*b* on the opposite end of slide 60 and from there extends through hole 82 and opening 38.

For right cord ladder 18, the upper stretch of front warp 50*a* is coupled with left locking post 86*a* of right slide 62, extends through cord hole 90 and from there through cord opening 40. The upper stretch of rear warp 50*b* is coupled with right locking post 86*b* at the opposed end of slide 62 and also extends through hole 90 and opening 40.

Connecting cable 64 is received in locking anchor 76*b* of left slide 60 and in locking anchors 84*a,b* in right slide 62. Cable 64 interconnects slides 60, 62 so that they shift along bottom wall 26 in synchrony. Spring 68 is positioned between locking post 86*b* and the right edge of bottom wall 26 and biases slides 60, 62 toward the right as viewed in FIG. 1.

Tilt cord 66 is received in locking anchor 76*a* of left slide 60 and extends over tilt guide 70. In the embodiment of FIG. 1, cord 66 extends along the side of blind 10 for grasping by the user. In another embodiment, such as the use in a double glazed panel illustrated in FIG. 5, cord 66 can be connected to a rotatable knob extending through a glazing panel. As another alternative, tilt cord 66 can be ganged by way of angled cord guide 72 with lift cords 46 and 54. Still another embodiment includes replacement of spring 68 with second tilt cord 92 illustrated by the dashed lines in FIG. 1. Conventional locking posts (not shown) or the like can be provided as needed for holding tilt cord 66 in a selected position.

As best viewed in FIGS. 1 and 3–4, left lift cord 46 extends through cord opening 38, between the lower surface of left slide 60 and bottom wall 26, around angled cord guide 72 and over back wall 22. Similarly, right lift cord 54 extends through cord opening 40, between right slide 62 and bottom wall 26 and around angled cord guide 72 by way of cord guide 80 on slide 60. Pulling on lift cords 46 and 54 raises bottom rail 48 and slats 14 in the conventional manner.

In operation, a user can tilt slats 14 by pulling on tilt cord 66. This causes slides 60 and 62 to shift leftwardly against the bias of spring 68.

Figure 6:
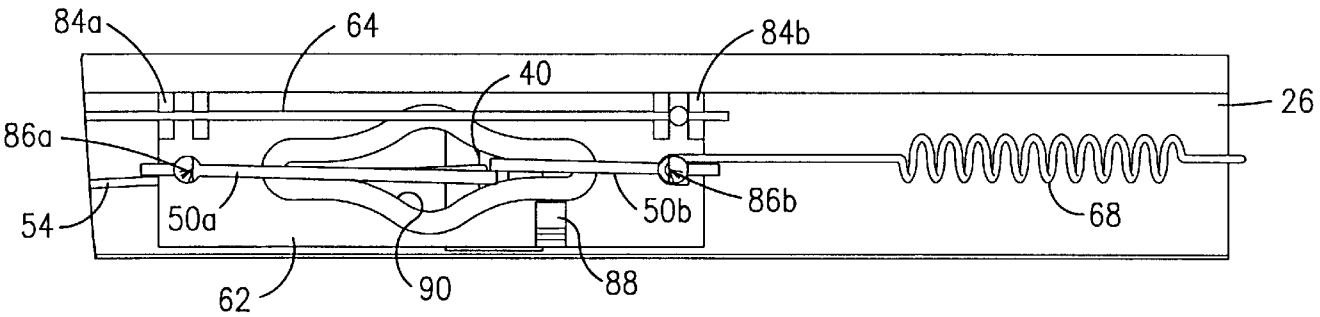
FIG. 6 is a partial, top elevational view of the blind of FIG. 1 showing the tilt mechanism in a first tilt position.
Figure 8:
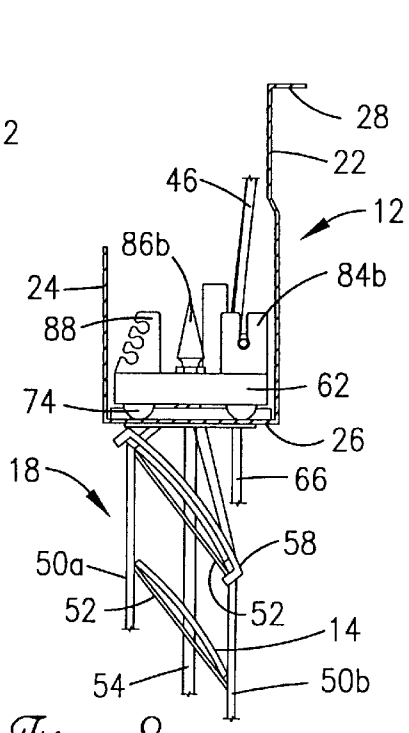
FIG. 8 is a view in partial section taken along line 8—8 of FIG. 7.
Figure 7:
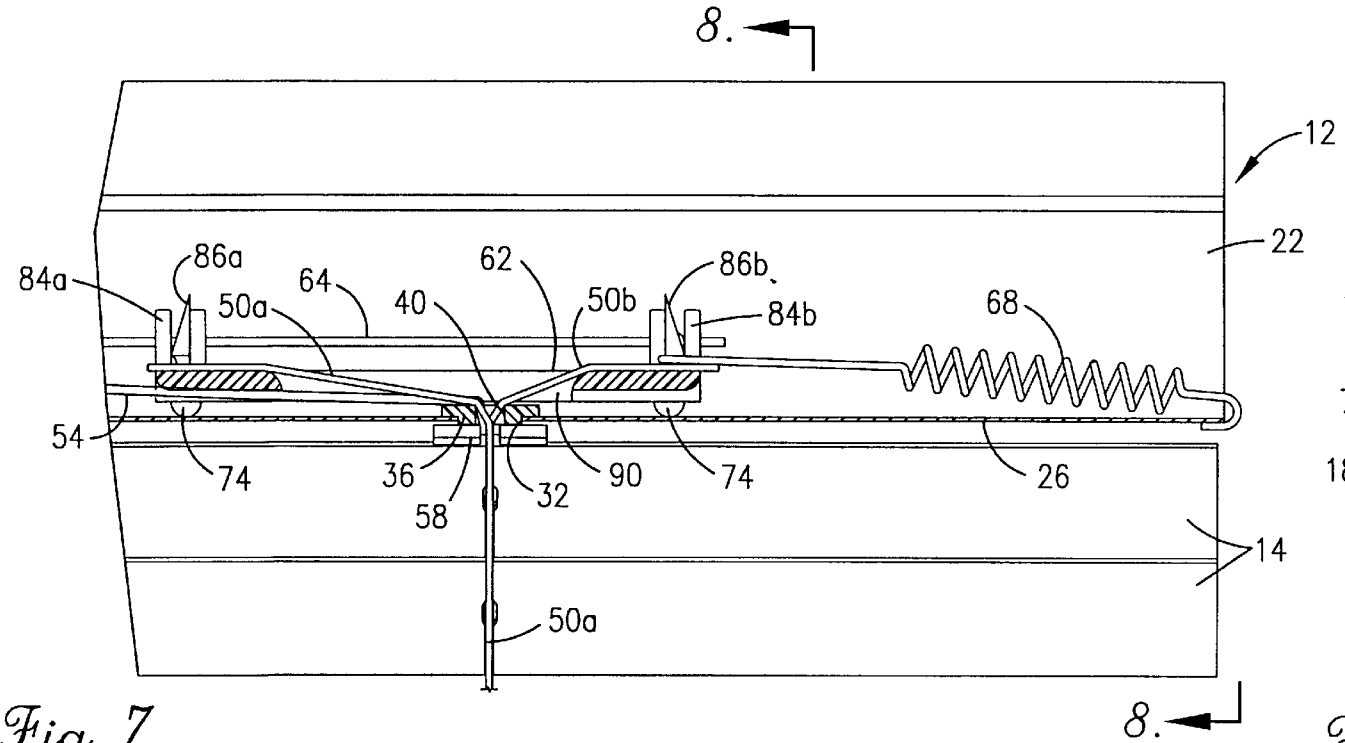
FIG. 7 is an elevational view of the blind of FIG. 6.

As slide 60 moves toward the left (see FIG. 3), front warp 42*a* is retracted through cord hole 82 and cord opening 38. At the same time, rear warp 42*b* is extended through hole 82 and opening 38. Similarly, slide 62 moves toward the left, front warp 50*a* is retracted through cord hole 90 and cord opening 40, and rear warp 50*b* is extended through these ports. As a result, wefts 44 shift and tilt slats 14 rearwardly as illustrated in FIGS. 6–8, for example. When the rightmost portions of cord holes 82 and 90 are centered over cord openings 38 and 40 respectively, this represents the leftmost position for slides 60 and 62 and the limit of rearward tilt of slats 14.

Figure 9:
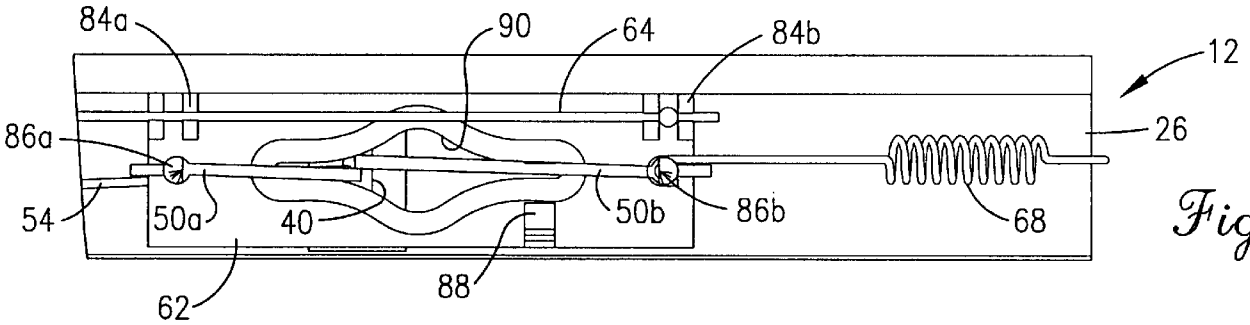
FIG. 9 is a view similar to FIG. 6 but showing the tilt mechanism in a second tilt position.
Figure 11:
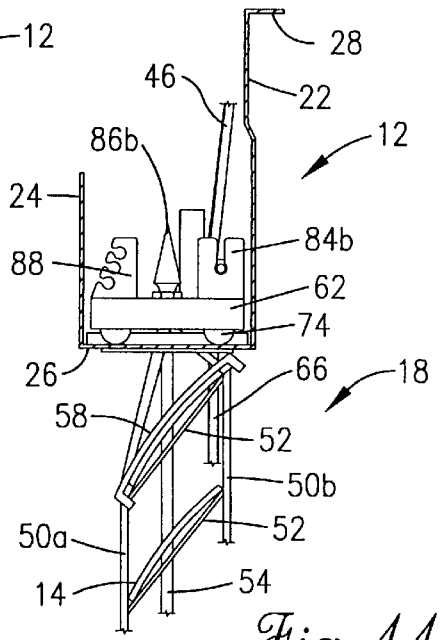
FIG. 11 is a view in partial section taken along line 11—11 of FIG. 10.
Figure 10:
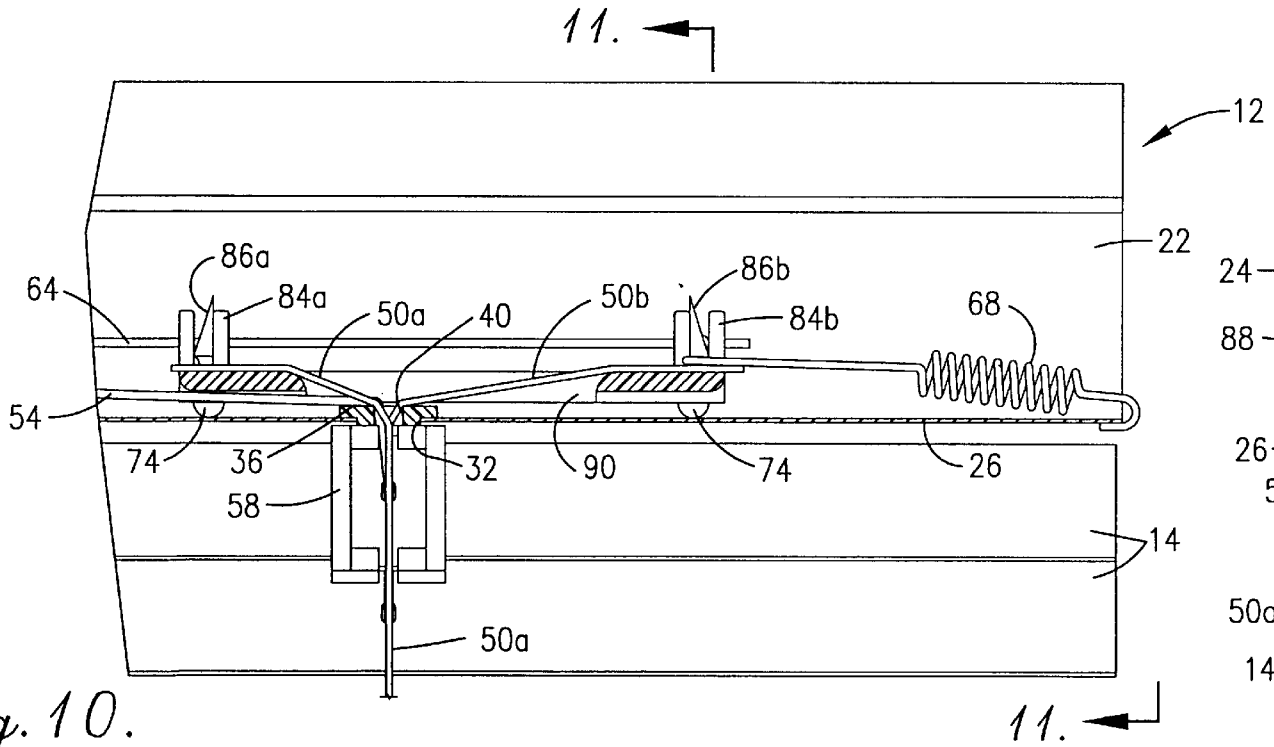
FIG. 10 is an elevational view of the blind of FIG. 9.

The user can also tilt slats 14 in the other direction by releasing tilt cord 66. The bias of spring 68 pulls slides 60 and 62 to the right as illustrated in FIGS. 9–11, which reverses the action discussed above. In particular, front warps 42*a* and 50*a* are extended and rear warps 42*b* and 50*b* are retracted in order to tilt slats 14 forwardly as shown in FIG. 11. When the leftmost portions of cord holes 82 and 90 are centered over cord openings 38 and 40 respectively, slides 60, 62 are in their rightmost position and slats 14 are at the limit of forward tilt.

Between the leftmost and rightmost positions, slides 60, 62 (and slats 14) can be placed in a plurality of intermediate positions including the middle position as represented in FIGS. 1 and 5. When slats 14 are in a desired position, the user can then secure tilt cord 66 using a locking anchor, locking post or the like. If a locking knob is used, this would hold tilt cord 66 in position.

Those skilled in the art will appreciate that the present invention encompasses many variations in the preferred embodiments disclosed herein. For example, the invention can include three or more cord ladders. Also, other types of shiftable bodies could be used in place of the preferred slides. In addition, the invention encompasses support members such as a pair of spaced rods for shiftably supporting the support bodies instead of the preferred headrail. In another example, connecting cable 64 could be replaced with a solid rod to allow both pushing and pulling of the slides due to tilt cord actions. Having thus described the preferred embodiment of the present invention, the following is claimed as new and desired to be secured by Letters Patent:

We claim:

1. A slatted blind comprising:

a support member including structure defining a cord opening;

a plurality of slats;

a cord ladder having a pair of warps depending from said member through said opening and having a plurality of wefts extending between said warps supporting said slats; and a tilt mechanism including a shifting body presenting opposed ends, shiftably supported by said support member, and shiftable in opposed directions relative to said opening, coupling means coupling said warps with said body in spaced relationship on opposed sides of said opening, and shifting means for selectively shifting said body in said directions for alternately retracting one of said warps while extending the other of said warps for tilting said slats, said support member including a headrail having a bottom wall with said cord opening defined therein, said shifting body including a slide supported by said bottom wall and slidable in said opposed directions thereon, said slide including a cord hole defined therein with said warps extending therethrough.

2. The blind as set forth in claim 1, said cord hole being elongated and presenting a width about the same as the width of said cord opening and a length greater than said width.

3. The blind as set forth in claim 2, said shifting body being shiftable between a first position in which said slats are tilted in one direction, a second position in which said slats are tilted in the opposed direction, and a plurality of intermediate positions therebetween with one of said intermediate positions including a middle position in which said slats are substantially untilted.

4. The blind as set forth in claim 3, said length of said cord hole being about the length of travel of said slide between said first and second positions.

5. The blind as set forth in claim 4, said cord hole being in registration with said cord opening when said slide is in said middle position.

6. The blind as set forth in claim 1, said shifting body being shiftable between a first position in which said slats are tilted in one direction, a second position in which said slats are tilted in the opposed direction, and a plurality of intermediate positions therebetween with one of said intermediate positions including a middle position in which said slats are substantially untilted.

7. The blind as set forth in claim 1, said coupling means including a pair of locking posts respectively coupling said warps with said shifting body.

8. A slatted blind comprising:

a support member including structure defining a cord opening;

a plurality of slats;

a cord ladder having a pair of warps depending from said member through said opening and having a plurality of wefts extending between said warps supporting said slats; and a tilt mechanism including a shifting body presenting opposed ends, shiftably supported by said support member, and shiftable in opposed directions relative to said opening, coupling means coupling said warps with said body in spaced relationship on opposed sides of said opening, and shifting means for selectively shifting said body in said directions for alternately retracting one of said warps while extending the other of said warps for tilting said slats, said blind further including a pair of said cord ladders adjacent the respective ends of said slats and a pair of said shifting bodies with the warps of said cord ladders depending respectively from said shifting bodies.

9. The blind as set forth in claim 8, said shifting bodies being interconnected for synchronous shifting.

10. The blind as set forth in claim 1, said shifting means including biasing means biasing said shifting body in one of said directions and a tilt cord coupled with said shifting body for shifting thereof in the opposite direction against the bias of said bias means.

11. The blind as set forth in claim 10, said biasing means including a spring.

12. The blind as set forth in claim 1, said shifting means including a pair of tilt cords coupled with said shifting body and configured for selectively shifting said body in said opposed directions respectively.

13. The blind as set forth in claim 1 further including a lift cord extending through said slats for lifting said slats.

14. A slatted blind comprising:

a headrail having a bottom wall with a pair of spaced cord openings defined therein;

a plurality of slats;

a pair of cord ladders each having a pair of warps depending from said headrail through said openings respectively and each having a plurality of wefts extending between said warps thereof supporting said slats; and a tilt mechanism including a pair of spaced slides each presenting opposed ends, said slides being slidably supported by said bottom wall and slidable in opposed directions relative to said openings respectively, each of said slides including a cord hole with a respective pair of warps extending therethrough, coupling means coupling said warps of each cord ladder with a respective slide in spaced relationship therewith on opposed sides of said openings respectively, connecting means interconnecting said slides for synchronous sliding, shifting means for selectively shifting said slides in said directions for alternately retracting a corresponding one of said warps of each cord ladder while extending the corresponding other of said warps of each cord ladder for tilting said slats, said slides being shiftable between a first position in which said slats are tilted in one direction, a second position in which said slats are tilted in the opposed direction, and a plurality of intermediate positions therebetween with one of said intermediate positions including a middle position in which said slats are substantially untilted, said cord holes being in registration with said cord openings respectively in said middle position, said cord holes being elongated, presenting widths about equal the widths of said cord openings and presenting lengths about the length of travel of said slides between said first and second positions.

15. The blind as set forth in claim 14, said shifting means including biasing means biasing said slides in one of said directions and a tilt cord coupled with said slides for shifting thereof in the opposite direction against the bias of said bias means.

16. The blind as set forth in claim 15, said biasing means including a spring.

17. The blind as set forth in claim 14, said shifting means including a pair of tilt cords coupled with said slides and configured for selectively shifting said slides in said opposed directions respectively.

* * * * *